US007962058B2

(12) United States Patent
Okamura

(10) Patent No.: US 7,962,058 B2
(45) Date of Patent: Jun. 14, 2011

(54) IMAGE FORMING APPARATUS FOR DETERMINING A SHEET SIZE, AN IMAGE FORMING METHOD FOR DETERMINING A SHEET SIZE AND A COMPUTER PROGRAM PRODUCT THEREOF

(75) Inventor: Tomoaki Okamura, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 486 days.

(21) Appl. No.: 12/081,678

(22) Filed: Apr. 18, 2008

(65) Prior Publication Data

US 2008/0260414 A1 Oct. 23, 2008

(30) Foreign Application Priority Data

Apr. 23, 2007 (JP) ..... 2007-113289

(51) Int. Cl.
*G03G 15/00* (2006.01)

(52) U.S. Cl. ..... 399/86; 399/82; 399/85

(58) Field of Classification Search ..... 399/82, 399/85, 86

See application file for complete search history.

(56) References Cited

U.S. PATENT DOCUMENTS

| | | | | |
|---|---|---|---|---|
| 4,796,056 | A * | 1/1989 | Ito | 399/86 |
| 5,289,236 | A * | 2/1994 | Yoshino | 399/86 |
| 2007/0116486 | A1 * | 5/2007 | Katahira | 399/82 |

FOREIGN PATENT DOCUMENTS

JP 2005-278143 10/2005

* cited by examiner

*Primary Examiner* — Ryan D Walsh
(74) *Attorney, Agent, or Firm* — Harness, Dickey & Pierce, P.L.C.

(57) ABSTRACT

A sheet-size decision table indicative of a correspondence of a plurality of sheet sizes and an image size printable on each sheet size is prepared in advance. An acquiring unit acquires image data, and an extracting unit extracts an image size of the image data. A searching unit searches the sheet-size decision table for a sheet size corresponding to the image size. If the searching unit cannot find a sheet size corresponding to the image size, a selecting unit selects a sheet size that can accommodate the image data when printed. Finally, a printing unit prints the image data on a print sheet corresponding to the sheet size selected by the selecting unit.

15 Claims, 8 Drawing Sheets

FIG. 7

T

| ORIGINAL | DIRECTION | dpi | WIDTH | HEIGHT |
|---|---|---|---|---|
| A3 | PORTRAIT | 200 | 2338 | 3307 |
| A4 | PORTRAIT | 200 | 1654 | 2338 |
| A5 | PORTRAIT | 200 | 1169 | 1654 |
| B4 | PORTRAIT | 200 | 2024 | 2866 |
| B5 | PORTRAIT | 200 | 1433 | 2024 |
| A3 | PORTRAIT | 300 | 3507 | 4960 |
| A4 | PORTRAIT | 300 | 2480 | 3507 |
| A5 | PORTRAIT | 300 | 1754 | 2480 |
| B4 | PORTRAIT | 300 | 3035 | 4299 |
| B5 | PORTRAIT | 300 | 2149 | 3035 |
| A3 | PORTRAIT | 400 | 4676 | 6614 |
| A4 | PORTRAIT | 400 | 3307 | 4676 |
| A5 | PORTRAIT | 400 | 2338 | 3307 |
| B4 | PORTRAIT | 400 | 4047 | 5732 |
| B5 | PORTRAIT | 400 | 2866 | 4047 |
| A3 | PORTRAIT | 600 | 7014 | 9920 |
| A4 | PORTRAIT | 600 | 4960 | 7014 |
| A5 | PORTRAIT | 600 | 3507 | 4960 |
| B4 | PORTRAIT | 600 | 6070 | 8598 |
| B5 | PORTRAIT | 600 | 4298 | 6070 |

(2-1)

| dpi | WIDTH | HEIGHT | IMAGE FORMAT |
|---|---|---|---|
| 600 | 7200 | 10000 | JPEG |

(2-2)

| dpi | WIDTH | HEIGHT | IMAGE FORMAT |
|---|---|---|---|
| 600 | 6070 | 8598 | JPEG |

IMAGE FORMING APPARATUS FOR DETERMINING A SHEET SIZE, AN IMAGE FORMING METHOD FOR DETERMINING A SHEET SIZE AND A COMPUTER PROGRAM PRODUCT THEREOF

CROSS-REFERENCE TO RELATED APPLICATIONS

The present application claims priority to and incorporates by reference the entire contents of Japanese priority document 2007-113289 filed in Japan on Apr. 23, 2007.

BACKGROUND OF THE INVENTION

1. Field of the Invention

The present invention relates to an image forming apparatus, a computer program product, and an image forming method.

2. Description of the Related Art

Recently, networking of image forming apparatuses, such as printers and multifunction printers (MFP), has been rapidly developing. Operators can instruct printing of image data or the like to an image forming apparatus from a client terminal networked to the image forming apparatus.

An image forming apparatus has been developed that has a sheet-size decision table that makes the sheet sizes of print sheets correspond to the orientations (directions) of the print sheets and image sizes (width, height, resolution) of the image data printable on the print sheets. By referring to the sheet-size decision table, the image forming apparatus selects a sheet size corresponding to the image size of image data whose printing is instructed from client terminals, and prints the image data on the print sheet of the sheet size selected. However, a problem occurs when a client terminal instruct printing of image data of an image size that is not available in the sheet-size decision table.

SUMMARY OF THE INVENTION

It is an object of the present invention to at least partially solve the problems in the conventional technology.

According to an aspect of the present invention, there is provided an image forming apparatus including a storage unit that stores therein a sheet-size decision table indicative of a correspondence of a plurality of sheet sizes and an image size printable on each sheet size; an acquiring unit that acquires image data; an extracting unit that extracts an image size of the image data; a searching unit that searches the sheet-size decision table for a sheet size corresponding to the image size; a selecting unit that selects, when the searching unit cannot find a sheet size corresponding to the image size, a sheet size that can accommodate the image data when printed; and a printing unit that prints the image data on a print sheet corresponding to the sheet size selected by the selecting unit.

According to another aspect of the present invention, there is provided an image forming method including preparing a sheet-size decision table indicative of a correspondence of a plurality of sheet sizes and an image size printable on each sheet size; acquiring image data and extracting an image size of the image data; searching the sheet-size decision table for a sheet size corresponding to the image size; selecting, when a sheet size corresponding to the image size is not found at the searching, a sheet size that can accommodate the image data when printed; and printing the image data on a print sheet corresponding to the sheet size selected at the selecting.

According to still another aspect of the present invention, there is provided a computer program product comprising a computer usable medium having computer readable program codes embodied in the medium that, when executed, causes a computer to execute the above method.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a schematic for explaining contents of a sheet-size decision table;

DETAILED DESCRIPTION OF THE PREFERRED EMBODIMENTS

Exemplary embodiments of the present invention are described below in detail with reference to the accompanying drawings.

Figure 1:
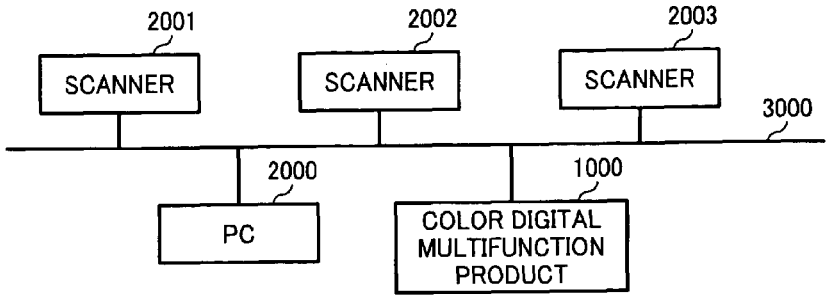
FIG. 1 is a block diagram of a network environment according to embodiments of the present invention.

A color digital multifunction product 1000 according to the embodiments, as shown in FIG. 1, is connected to other apparatuses such as a personal computer (PC) 2000 and scanners 2001, 2002, 2003 through a network 3000.

Figure 2:
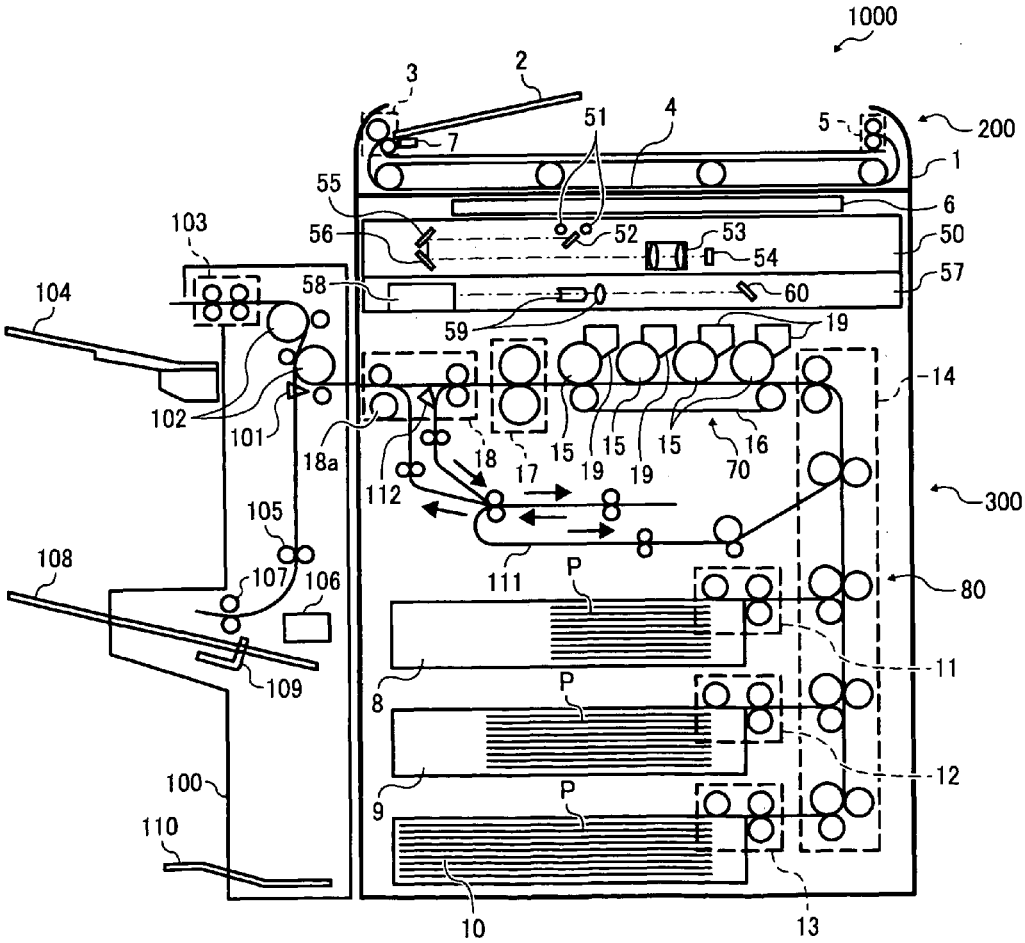
FIG. 2 is a schematic diagram of a digital multifunction product according to an embodiment of the present invention.
Figure 3:
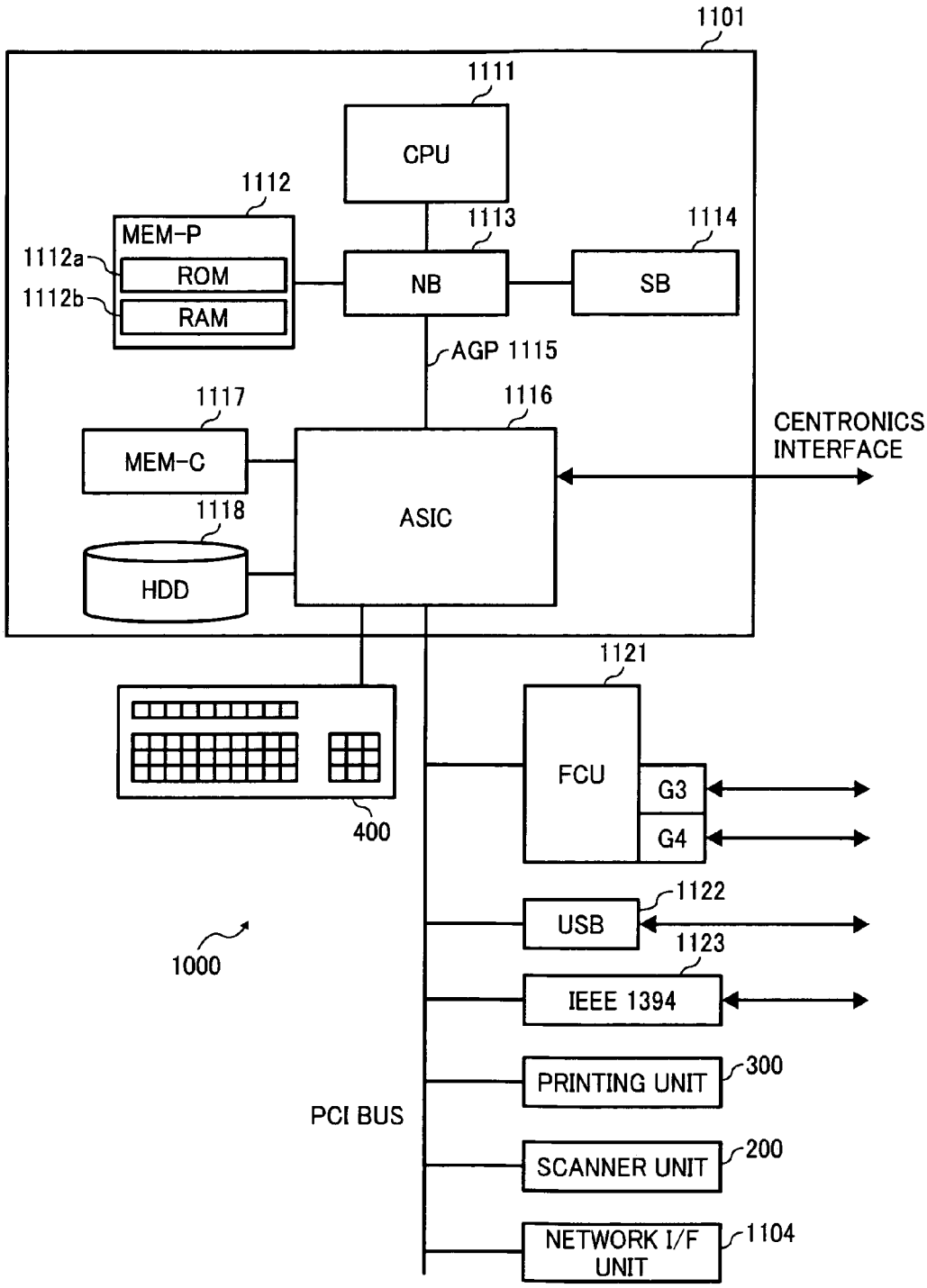
FIG. 3 is a block diagram of a hardware configuration of the digital multifunction product shown in FIG. 2.

A configuration of and operations performed by the color digital multifunction product 1000 according to the embodiment are described based on FIGS. 2 and 3. The embodiments use the color digital multifunction product, as an example, generally called a multifunction peripheral (MFP) with multi functions such as a copy function, a facsimile (FAX) function, a print function, a scan function, and a delivery function that delivers input images (original images scanned by the scan function, or input images input by the printer or the FAX function).

FIG. 2 is a schematic diagram of the color digital multifunction product 1000. The color digital multifunction product 1000 includes a finisher 100 that is a post processing apparatus, a scanner unit 200 that is an image scanning apparatus, and a printing unit 300 that is an image printing apparatus.

The color digital multifunction product 1000 makes it possible to select an original box function, a copy function, a print function, and a facsimile function by sequentially switching an application switching key in an operation displaying unit 400 (see FIG. 3). When selecting the original box function, an original box mode is set, when selecting the copy function, a copy mode is set, when selecting the print function, a print mode is set, and when selecting the facsimile function, a facsimile mode is set. An image forming flow in the copy mode is described with reference to FIG. 2 as an example.

At first, the scanner unit 200 is described. The scanner unit 200 includes an auto document feeder (ADF) 1 and a scanning unit 50.

A stack of originals is placed with the image side up on an original sheet tray 2 of the ADF 1. When a print key (not shown) on the operation displaying unit 400 is pressed by a user, a feeding roller 3 and a feeding belt 4 feed the lowest original from the stack onto a predetermined position on a contact glass 6. The color digital multifunction product 1000 has a count function that counts up the number of originals each time when an original of them is fed to a predetermined position on the contact glass 6.

Then, the scanning unit 50 scans the image data of the original that is fed onto the predetermined position on the contact glass 6.

The scanning unit 50 is described in detail here. The scanning unit 50 includes the contact glass 6 and an optical scanning system. The optical scanning system includes exposure lamps 51 that function as illuminating units, a first mirror 52, a lens unit 53, and a charge coupled device (CCD) image sensor 54. The exposure lamps 51 and the first mirror 52 are installed on a first carriage (not shown), and a second mirror 55 and a third mirror 56 are installed on a second carriage (not shown). A scanner drive motor (not shown) drives the optical scanning system. The scanning unit 50 provides a process in which an original is scanned by the exposure lamps 51 turned on and by traveling bodies, the first and the second carriages, moving and scanning to a right direction with a scanner driving motor when the original is placed on the contact glass 6 and another process in which an original that the ADF 1 is transporting is scanned by the exposure lamps 51 turned on while the first and the second carriages are halting. Any of the processes is selectable. In the scan process that an original is scanned by the first carriage and the second carriages moved to the right direction with the scanner driving motor, the first carriage and the second carriage are mechanically scanned in a subscanning direction with a relative velocity of the first carriage and the second carriage in a ratio of 2 to 1 to keep a light path length constant when an original image is scanned. The CCD image sensor 54 collects light reflected from the original image, converts the light into an electrical signal, and outputs the signal, which is analog signal. An analog to digital (AD) converter (not shown) converts the signal output from the CCD image sensor 54 into digital data (image data)., The digital data is used in various manners as information for each scanner unit 200. For example, the digital data is sent to the printing unit 300 for printing on a printing medium, or the digital data is sent to a storage apparatus (such as a hard disk drive (HDD) 1118 in FIG. 3) for storing. In an original box mode, the original image information stored in the storage apparatus (such as the HDD 1118) can be used for repeated output or other processes. Such original box function can realize paperless environment as well as improve the operating efficiency.

Once the original is scanned, the feeding belt 4 and a discharging roller 5 discharge it outside of the color digital multifunction product 1000.

If an original set detector 7 detects next original on the original sheet tray 2, the next original is fed onto the contact glass 6 in the same manner of the previous original.

The feeding motor drives each of the feeding roller 3, the feeding belt 4, and the discharging roller 5.

The printing unit 300 is described next. The printing unit 300 includes an image forming station 70, a fixing unit 17, a paper feeding unit 80, and a both-sided paper feeding unit 111.

The image forming station 70 forms images by an electrophotographic process. The image forming station 70 includes a writing unit 57, photosensitive bodies 15 of a tandem type with 4 drams, and developing units 19, which are set on each of the photosensitive bodies, correspond to cyan(C), magenta (M), yellow(Y), and black(B), and a transporting belt 16, in the shape like a belt, that transports the sheet so that images formed on the photosensitive body 15 can be sequentially transferred on a print sheet P at each transferring position.

The paper feeding unit 80 includes a first tray 8, a second tray 9, a third tray 10, a first paper feeding apparatus 11, a second paper feeding apparatus 12, a third paper feeding apparatus 13, and a vertical transporting unit 14. The first paper feeding apparatus 11, the second paper feeding apparatus 12, and the third paper feeding apparatus 13 feed print sheets P loaded in the first tray 8, the second tray 9, and the third tray 10, respectively and the vertical transporting unit 14 transports them to a position where the print sheet abuts on the photosensitive body 15 positioned in the upstream side of a transporting direction.

A laser beam emitted from the writing unit 57 writes the image data scanned by the scanning unit 50 in each photosensitive body 15. The passage through each developing unit 19 of the image data forms a toner image. The writing unit 57 includes a laser emitting unit 58, image formation lenses 59, and a mirror 60. The laser emitting unit 58 includes therein a laser diode of a laser light source and a polygon mirror that rotates at a high velocity with a motor. In addition, although not shown in FIG. 2, a beam sensor that generates main scanning synchronized signals is configured on a position on which a laser beam is irradiated near one end of each photosensitive body 15.

Each toner image on each photosensitive body 15 is transferred on the print sheet P that is transported by the transporting belt 16 with the velocity equal to the rotation of each photosensitive body 15 and a color image is formed on the print sheet P. Then, after the print sheet P is transported to the fixing unit 17 and the image is fixed thereon, a paper-discharging unit 18 discharges it to the finisher 100 of a post processing apparatus.

The finisher 100 can guide the print sheet P transported by a paper-discharging roller 18*a* in the paper-discharging unit 18 by switching from a regular paper-discharging roller 102 direction to a staple processing unit direction. More particularly, the finisher 100 can discharge the print sheet P to the regular paper-discharging tray 104 through the transporting roller 103 by switching a switching board 101 upward and can transport the print sheet P to a staple table 108 through transporting rollers 105 and 107 by switching the switching board 101 downward.

A jogger 109, which aligns paper sheets, aligns the end of loaded print sheets P on the staple table 108 each time when a sheet is discharged and a stapler 106 staples the sheets when copying of a set of sheets is completed. The group of the print sheets P, which sets have been stapled with the stapler 106, are placed by self-weight in a staple completion paper-discharging tray 110.

The regular paper-discharging tray 104 in the finisher 100 is a paper-discharging tray that is movable back and forth. The movable paper-discharging tray 104 sorts copied sheets simply discharged by moving back and forth for every original or every copy set sorted by an image memory.

The color digital multifunction product 1000 can form images on both sides of a print sheet P. When forming images on the both sides of a print sheet P, without guiding the print sheet P fed from each paper feeding tray 8, 9, or 10 to the paper-discharging tray 104 direction, the print sheet P is once stocked in the both-sided paper feeding unit 111 by setting a branch claw 112 upward to change the path of the paper-discharging unit 18. Then, a print sheet P stocked in the both-sided paper feeding unit 111 is again fed in a reversed state from the both-sided paper feeding unit 111 for toner images to be transferred thereon, the toner images being formed again on the photosensitive body 15. Further, the print sheet P is guided to the paper-discharging tray 104 through the branch claw 112 set downward. Thus, the both-sided paper feeding unit 111 is used when images are formed on the both sides of a print sheet P. The both-sided paper feeding unit 111 can be also used to reverse a print sheet P from the front side, on which an image has been copied, when the back side is copied thereon.

FIG. 3 is a block diagram of a hardware configuration of the color digital multifunction product 1000. The color digital multifunction product 1000 as shown in FIG. 3 has a structure that a controller 1101, the printing unit 300, and the scanner unit 200 are connected through a peripheral component interconnect (PCI) bus. The controller 1101 controls the entire color digital multifunction product 1000. Specifically, the controller 1101 controls an input from the operation displaying unit 400, image formation operation, and communications. The printing unit 300 or the scanner unit 200 includes an image processing unit that performs processing such as error diffusion and gamma conversion.

The controller 1101 includes a central processing unit (CPU) 1111, which is a main processing unit of a computer, a system memory (MEM-P) 1112, a north bridge (NB) 1113, a south bridge (SB) 1114, an application specific integrated circuit (ASIC) 1116, a local memory (MEM-C) 1117, and a-hard disk drive (HDD) 1118. An accelerated graphics port (AGP) bus 1115 connects the NB 1113 and the ASIC 1116. The MEM-P 1112 further includes a read only memory (ROM) 1112*a* and a random access memory (RAM) 1112*b*.

The CPU 1111 controls the operation of the entire digital multifunction product 1000. The CPU 1111 includes chip-sets comprised of the NB 1113, the MEM-P 1112, and the SB 1114, and it is connected to other apparatuses through the chip-sets.

The NB 1113 is a bridge to connect the CPU 1111 to the MEM-P 1112, the SB 1114, and the AGP bus 1115. The NB 1113 includes a memory controller (not shown) that controls writing to and reading from the MEM-P 1112, a PCI master, and an AGP target.

The MEM-P 1112 includes the ROM 1112*a* and the RAM 1112*b*. The MEM-P 1112 functions as a system memory that is used as a storage memory for computer programs and data, a developing memory for computer programs and data, an image forming memory for printers, and the like. The ROM 1112*a* functions as a read only memory that is used as a storage memory for data and computer programs for controlling operations of the CPU 1111. The RAM 1112*b* is a writable and readable memory and it is used as a developing memory for computer programs and data, an image forming memory for printers, and the like.

The SB 1114 is a bridge to connect the NB 1113 to PCI devices and peripheral devices. The SB 1114 is connected to the NB 1113 through the PCI bus. Moreover, a network interface (I/F) unit 1104 and the like are connected to this PCI bus.

The ASIC 1116 is an integrated circuit (IC) for processing images, the IC having hardware components of processing images, and functions as a bridge that connects the AGP bus 1115, the PCI bus, the HDD 1118, and the MEM-C 1117 to each other. Although not shown, the ASIC 1116 includes a PCI target and an AGP master, an arbiter (ARB) as a core of the ASIC 1116, a memory controller that controls the MEM-C 1117, a plurality of direct memory access controllers (DMAC) that perform rotation of image data or other actions by hardware logic or the like, and a PCI unit that transports data through a PCI bus between the printing unit 300 and scanner unit 200. The ASIC 1116 is connected to a FAX control unit (FCU) 1121, a universal serial bus (USB) 1122, the Institute of Electrical and Electronics Engineers 1394 (IEEE 1394) interface 1123 through the PCI bus.

The MEM-C 1117 is a local memory used as a copy image buffer and a code buffer. The HDD 1118 is a storage that stores therein image data, computer programs to control the operation of the CPU 1111, font data, and various forms.

The AGP bus 1115 is a bus interface for a graphic accelerator card proposed for accelerating graphic processes. The AGP bus 1115 accelerates the graphic accelerator card by direct access to the MEM-P 1112 in a high throughput.

A print process, which is a characteristic of a first embodiment, performed when a print function is selected is described below. The controller 1101 realizes this print function according to a computer program.

Figure 4:
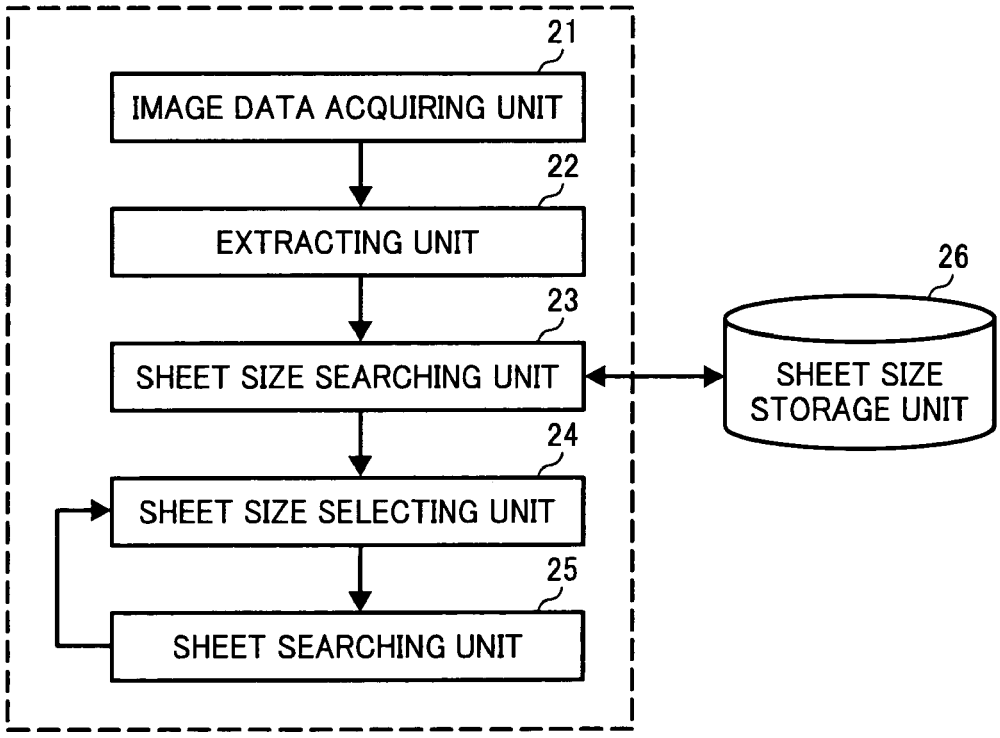
FIG. 4 is a block diagram of a functional configuration for a print process according to a first embodiment of the present invention.
Figure 5:
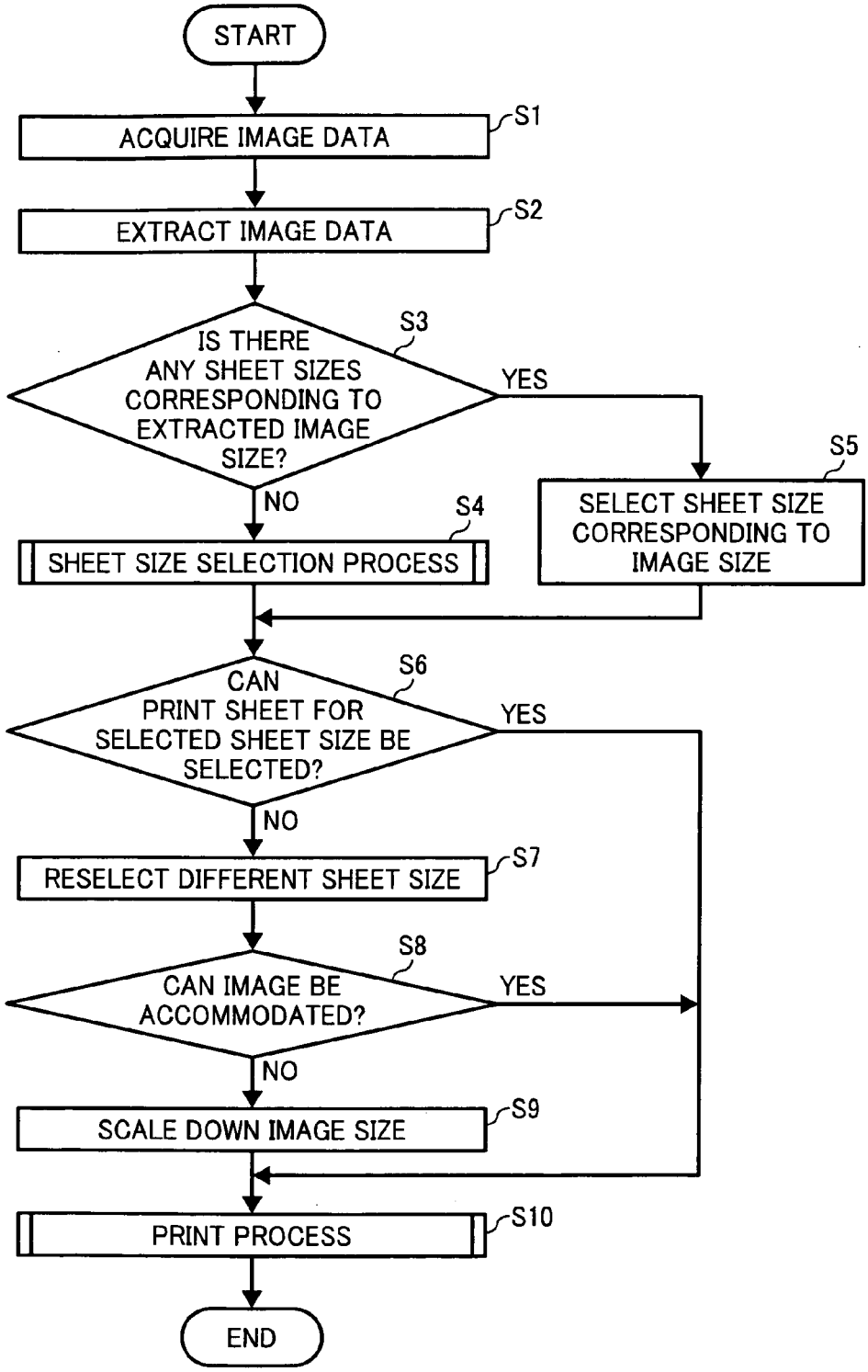
FIG. 5 is a flowchart of the print process shown in FIG. 4.
Figure 6:
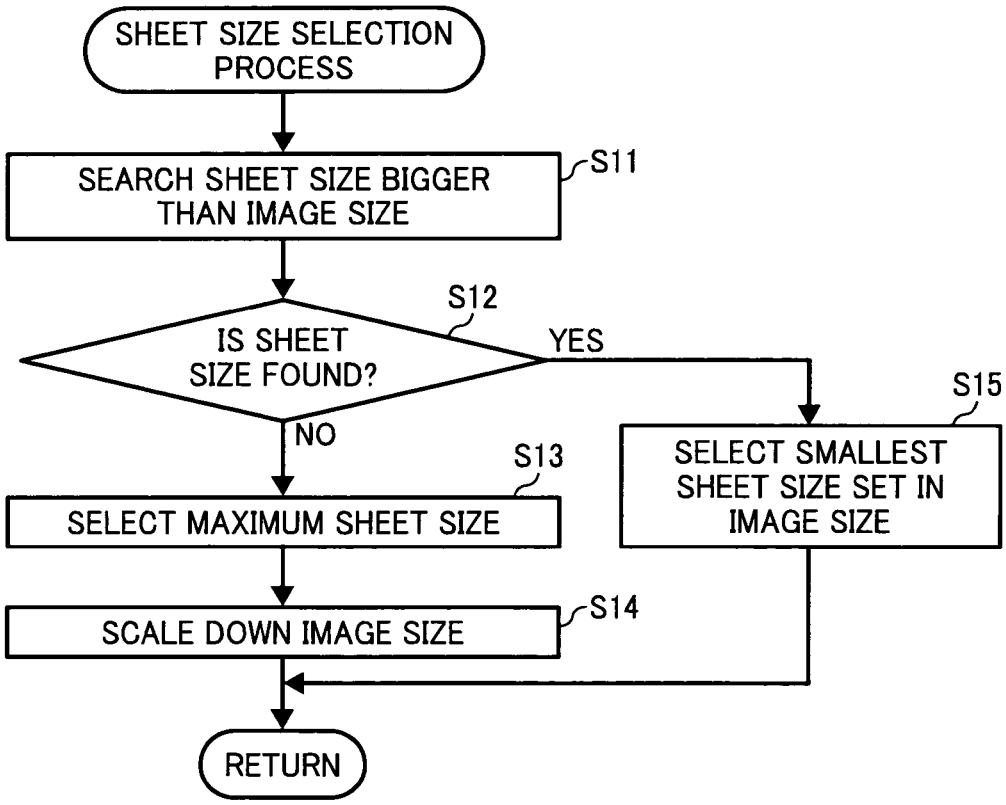
FIG. 6 is a flowchart of a sheet selection process shown in FIG. 4.

FIG. 4 is a block diagram of a functional configuration of a print process when a copy function is selected. FIG. 5 is a flowchart of the print process. FIG. 6 is a flowchart of a sheet selection process. FIG. 7 is a schematic for explaining contents of a sheet-size decision table.

As shown in FIG. 4, with the CPU 1111 performing according to computer programs, the color digital multifunction product 1000 realizes an image data acquiring unit 21, an extracting unit 22, a sheet size searching unit 23, a sheet size selecting unit 24, and a sheet searching unit 25. The image data acquiring unit 21 acquires image data from external apparatuses connected to a network. The extracting unit 22 extracts an image size of the acquired image data. The sheet size searching unit 23 searches a sheet size corresponding to the extracted image size. The sheet size selecting unit 24 selects a sheet size in which the image data can be accommodated when printed based on the image size when no sheet size corresponds to the image size. The sheet searching unit 25 searches a paper feeding unit that can feed the print sheet of the sheet size selected. As shown in FIG. 7, the color digital multifunction product 1000 also realizes a sheet size storage unit 26 by storing a sheet-size decision table T in the HDD 1118, in which the sheet-size decision table T makes the sheet sizes of print sheets correspond to the image sizes of image data printable on the print sheets.

The sheet-size decision table T, as shown in FIG. 7, makes the print sizes of print sheets correspond to orientations (directions) of the print sheets and the image sizes (resolution, width, and height) of image data printable on the print sheets.

Figures 8, 9:
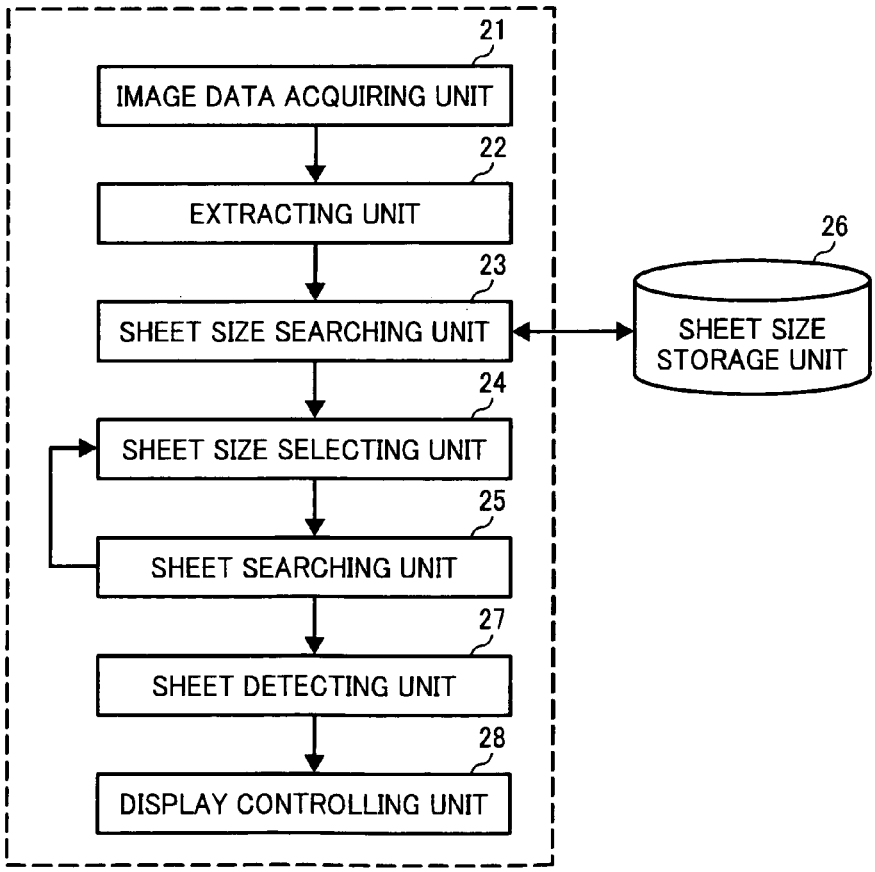
FIG. 8 is a schematic for explaining attribution information entered in a tag in image data.
FIG. 9 is a block diagram of a functional configuration of a print process according to a second embodiment of the present invention.

The image data acquiring unit 21 acquires image data from another apparatus via a network (Step S1). The image data acquiring unit 21 can acquire the image data from the scanners 2001, 2002, 2003, or the PC 2000 connected to a network 3000 through the IEEE 1394 (1123). The image data that is a TIFF type image data has an identifier called "tag", in which attribution information of image data is entered, in the head part of the image data so that different operation systems (OS) or computers can exchange image data therebetween. As shown in FIG. 8, the attribution information is assumed to hold image sizes (resolution, width, and height) that are a display area size of the image data.

The extracting unit 22 extracts an image size of image data acquired by the image data acquiring unit 21 (Step S2). The color digital multifunction product 1000 extracts attribution information on the image size of the image data from the head tag of the image data acquired by the image data acquiring-unit 21. More particularly, at first, the extracting unit 22 determines whether the format of image data entered in a tag is TIFF type. When the format of the image data is not TIFF type, a print process is completed because the format is not available for the color digital multifunction product 1000. On the other hand, when the format of the image data is TIFF type, the image size of the image data entered in the tag is extracted.

The sheet size searching unit 23 searches a sheet size corresponding to the image size extracted by the extracting unit 22 based on the sheet-size decision table T (Step S3). The sheet size searching unit 23 searches the sheet size from the sheet-size decision table T stored in the sheet size storage unit 26.

The sheet size selecting unit 24, when the sheet size searching unit 23 cannot find the sheet size corresponding to the image size (No at Step S3), executes a sheet size selection process for selecting a printable sheet size for the image data based on the image size (Step S4). The sheet size selecting unit 24, when the sheet size searching unit 24 can find the sheet size corresponding to the image size (Yes at Step S3), selects the sheet size corresponding to the image size (Step S5).

The sheet size selection process performed at Step S4 is described below with reference to FIG. 6. The sheet size selecting unit 24 searches a sheet size that is bigger than the image size from the sheet-size decision table T (Step S11 in FIG. 6). Then, when a plurality of such sheet sizes is found (Yes at Step S12), the sheet size selecting unit 24 selects a sheet size that is the smallest among the found sheet sizes (Step S15). On the other hand, when no such sheet size is found (No Step S12), the sheet size selecting unit 24 selects a sheet size that is the largest sheet size available in the sheet-size decision table T (Step S13). If the largest sheet size is selected, the sheet size selecting unit 24 scales down the image size so that the image can be printed on the selected sheet size (Step S14).

Returning to the explanation of FIG. 5, the sheet searching unit 25 searches a paper feeding unit that can feed the print sheets of the selected sheet size (Step S6). Specifically, the sheet searching unit 25 searches the paper feeding apparatuses (11, 12, and 13) that can feed the print sheets of the selected sheet size. The paper feeding apparatuses (11, 12, and 13) have a unit that detects paper size set in the first, the second, and the third trays (8, 9, and 10). The sheet searching unit 25 searches the paper feeding apparatuses (11, 12,and 13) that can feed the print sheets of the sheet sizes selected by the sheet size selecting unit 24 based on the sheet size of each tray detected by the paper feeding apparatuses (11, 12, and 13). It is assumed that papers of size B5 are set lengthwise in the first tray 8 of the first paper feeding apparatus 11, papers of size A4 are set lengthwise in the second tray 9 of the second paper feeding apparatus 12, and papers of size A3 are set lengthwise in the third tray 10 of the third paper feeding apparatus 13.

When the sheet searching unit 25 does not find the paper feeding apparatuses (11, 12, and 13) (No at Step S6) that can feed the print sheets of the sheet sizes selected at Step S4 or Step S5 in FIG. 5, the sheet size selecting unit selects a different sheet size (Step S7 in FIG. 5). For example, the sheet size selecting unit 24 reselects the sheet size of print sheets set in a tray predetermined by users (hereinafter, "priority paper tray") (Step S7). It is assumed that the first tray 8 is used with priority.

The sheet size selecting unit 24 determines whether the selected sheet size is big enough to accommodate the image size (Step S8). Specifically, the sheet size selecting unit 24 determines whether the image size extracted at Step S3 can be accommodated in the sheet size selected at Steps S4, S5, or S7. If the image size can be accommodated (Yes at Step S8), a print process starts (Step S10 in FIG. 5). On the other hand, if the image size cannot be accommodated (No at Step S8), the sheet size selecting unit 24 scales down the image size so that it can fit in the selected sheet size (Step S9). For example, at Step S7 in FIG. 6, if a sheet size (lengthwise B5) set in the priority paper feeding tray (the first tray 8) is selected, the sheet size selecting unit 24 scales down the image size for setting in the lengthwise B5. Once the sheet size selecting unit 24 scales down the image size, a print process starts (Step S10).

In this manner, the color digital multifunction product 1000 extracts image sizes entered in a tag of image data sent from a client terminal connected to a network and searches a sheet size corresponding to the image size extracted from a sheet-size decision table. When no sheet size that can accommodate the image is found, a sheet size that can accommodate the image is selected. In other words, an image can be printed on a paper of an appropriate size even when the sheet-size decision table does not contain the image size of the image data sent from the client terminal. Therefore, operability for a series of operations to perform print processes can be improved.

Figure 10:
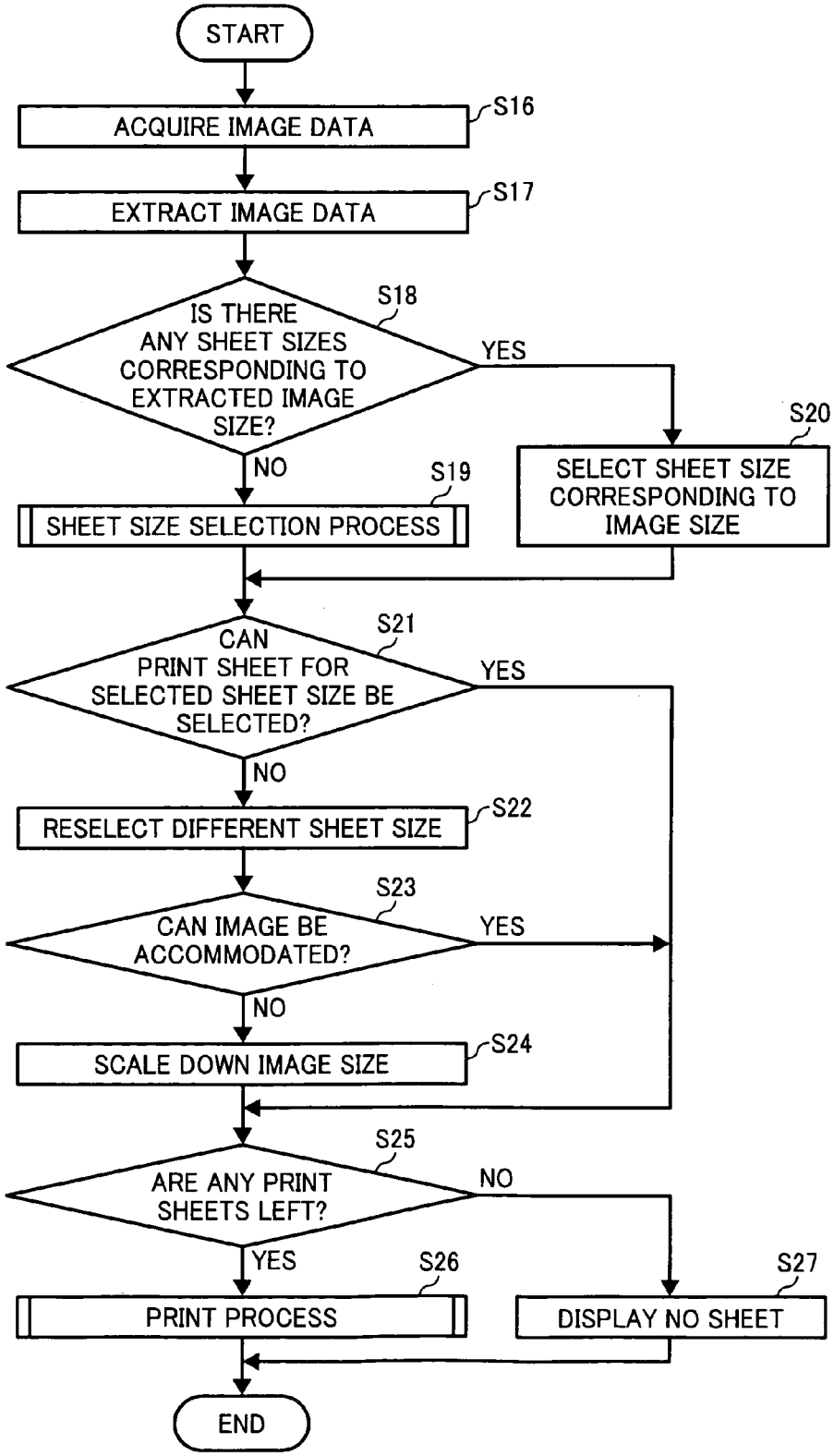
FIG. 10 is a flowchart of the print process shown in FIG. 9.

It is possible that paper of the selected sheet size is not present in the paper tray. FIG. 9 is a block diagram of a functional configuration of a print process performed when that paper of the selected sheet size is not present in the paper tray. FIG. 10 is a flowchart of the print process shown in FIG. 9. As shown in FIG. 9, with the CPU 1111 performing according to computer programs, the color digital multifunction product 1000 realizes the image data acquiring unit 21, the extracting unit 22, the sheet size searching unit 23, the sheet size selecting unit 24, the sheet searching unit 25, a sheet detecting unit 27, and a display controlling unit 28. The image data acquiring unit 21 acquires image data from external apparatuses connected to a network. The extracting unit 22 extracts an image size of the acquired image data. The sheet size searching unit 23 searches a sheet size corresponding to the extracted image sizes. The sheet size selecting unit 24 selects a sheet size that can accommodate the image data based on the image size when no sheet size corresponds to the image size. The sheet searching unit 25 searches a paper feeding unit that can feed the print sheet of the selected sheet size. The sheet detecting unit 27 detects whether print sheets of the sheet size selected by the paper feeding unit that feeds print sheets to a printing unit are left. The display controlling unit 28 causes a displaying unit to display a message to notify that no paper is left, when no print sheet is left in the paper feeding unit. As shown in FIG. 7, the color digital multifunction product 1000 also realizes the sheet size storage unit 26 by storing a sheet-size decision table T in the HDD 1118, in which the sheet-size decision table T makes the sheet sizes of print sheets correspond to the image size of image data printable on the print sheet. The image data acquiring unit 21, the extracting unit 22, the sheet size searching unit 23, the sheet size selecting unit 24, and the sheet searching unit 25 shown in FIG. 9 operate in the same manner as explained with reference to FIGS. 5 and 6.

The sheet detecting unit 27 detects whether print sheets of the sheet size selected by the sheet size selecting unit 24 is left in the paper feeding unit that feeds print sheets to the printing unit (Step S25 in FIG. 10). In the present embodiment, the sheet detecting unit 27 detects whether the print sheets of the sheet size selected by the sheet size selecting unit 24 is left respectively in the first, the second, and the third trays of the paper feeding apparatuses 11, 12, and 13. When the sheet detecting unit 27 detects the print sheet of the sheet size selected (Yes at Step S25), a print process starts (Step S26).

The display controlling unit 28 displays a message on the displaying unit that no paper is left in the paper feeding unit (Step S27). In this situation, the display controlling unit 28 urges users to supply print sheets in the trays by causing the operation displaying unit 400 to display a message indicating that no paper is left in the trays (the first, the second, and the third trays (8, 9, and 10)) when the sheet detecting unit 27 detects that no paper is left in the paper feeding unit. The print process is not performed when the sheet detecting unit 27 detects that no paper is left in the paper feeding unit. Instead of displaying on the operation displaying unit 400 the message that no paper is left, similar message can be displayed on a screen of a computer that is connected to the network. Alternatively, the message can be displayed on both the operation displaying unit 400 and the screen of a computer that is connected to the network.

Thus, the color digital multifunction product 1000 extracts image sizes entered in a tag of image data sent from client terminals, such as scanners and computers connected to a network, searches a sheet size corresponding to the image size from the sheet-size decision table, and selects an appropriate sheet size when no sheet size corresponding to the image size is found. When no print sheet is left in the paper tray, the color digital multifunction product 1000 notifies that no paper is available to the user. Thus, the color digital multifunction product 1000 can quickly recover from problems.

According to an aspect of the present invention, an image can be printed on a paper of appropriate size even if a paper of size specified from the client terminal is not available in the sheet-size decision table.

According to another aspect of the present invention, the fact that paper is not present in the paper tray is notified to the users, so that they can quickly replenish the paper.

According to still another aspects of the present invention, an image is automatically scaled down so as to be accommodated on a paper of available size so that the operability can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a storage unit that stores therein a a correspondence of a plurality of sheet sizes and an image size printable on each sheet size;

an acquiring unit that acquires image data from a host device, the image data including a header section;

an extracting unit that extracts an image size of the image data from attribute information in the header section;

a searching unit that searches for a sheet size corresponding to the image size based on the stored correspondence and the image size of the image data extracted from the attribute information;

a selecting unit that selects, when the searching unit cannot find a sheet size corresponding to the image size, a sheet size that can accommodate the image data when printed; and a printing unit that prints the image data on a print sheet corresponding to the sheet size selected by the selecting unit.

2. The image forming apparatus according to claim 1, further comprising:

a paper feeding unit that accommodates print sheets of various sizes and feeds a print sheet to the printing unit;

a sheet detecting unit that detects whether the print sheet of the sheet size selected by the selecting unit is left in the paper feeding unit; and a display controlling unit that causes a displaying unit to display a message to notify that the print sheet of the sheet size selected by the selecting unit is not left in the paper feeding unit when the sheet detecting unit cannot detect the print sheet of the sheet size selected by the selecting unit in the paper feeding unit.

3. The image forming apparatus according to claim 1, wherein, when the searching unit finds a plurality of sheet sizes corresponding to the image size, the selecting unit selects a sheet size that is smallest from among found sheet sizes.

4. The image forming apparatus according to claim 3, wherein, when the searching unit cannot find a sheet size corresponding to the image size, the selecting unit selects a sheet size that is biggest from among the sheet sizes in the sheet-size decision table, and scales down the image size so that the image size can fit in selected sheet size when printed.

5. The image forming apparatus according to claim 1, further comprising:

a plurality of paper feeding units each accommodating print sheets of corresponding size and feeds a print sheet to the printing unit; and a feeding-unit searching unit that searches a paper feeding unit that can feed a print sheet of the print size selected by the selecting unit, wherein when the feeding-unit searching unit cannot find a paper feeding unit, the selecting unit newly selects a sheet size;

determines whether the image size can be accommodated in newly selected sheet size; and scales down the image data so that image size of scaled-down image data is accommodated in the newly selected sheet size when printed upon determining that the image size cannot be accommodated in the newly selected sheet size.

6. A computer program product comprising a non-transient computer usable medium having computer readable program codes embodied in the medium that, when executed, causes a computer to execute:

preparing a correspondence between a plurality of sheet sizes and an image size printable on each sheet size;

acquiring image data from a host device, the image data including a header section and extracting an image size of the image data from attribute information in the header section;

searching for a sheet size corresponding to the image size based on the correspondence between the plurality of sheet sizes and the image size and the image size of the image data extracted from the attribute information;

selecting, when a sheet size corresponding to the image size is not found at the searching, a sheet size that can accommodate the image data when printed; and printing the image data on a print sheet corresponding to the sheet size selected at the selecting.

7. The computer program product according to claim 6, wherein the computer program further causing the computer to execute:

detecting whether the print sheet of the sheet size selected at the selecting is left in a paper feeding unit; and causing a displaying unit to display a message to notify that the print sheet of the sheet size selected at the selecting is not left in the paper feeding unit when the print sheet of the sheet size selected at the selecting in is not left in the paper feeding unit.

8. The computer program product according to claim 6, wherein, when a plurality of sheet sizes corresponding to the image size are found at the searching, the selecting includes selecting a sheet size that is smallest from among found sheet sizes.

9. The computer program product according to claim 8, wherein, when a sheet size corresponding to the image size is not found at the searching, the selecting include selecting a sheet size that is biggest from among the sheet sizes in the sheet-size decision table, and scaling down the image size so that the image size can fit in selected sheet size when printed.

10. The computer program product according to claim 6, wherein the computer program further causes the computer to execute searching a paper feeding unit that can feed a print sheet of the print size selected at the selecting, wherein when a paper feeding unit is not found in the searching, the selecting includes newly selecting a sheet size;

determining whether the image size can be accommodated in newly selected sheet size; and scaling down the image data so that image size of scaled-down image data is accommodated in the newly selected sheet size when printed upon determining that the image size cannot be accommodated in the newly selected sheet size.

11. An image forming method comprising:

preparing a correspondence of a plurality of sheet sizes and an image size printable on each sheet size;

acquiring image data from a host device, the image data including a header section and extracting an image size of the image data from attribute information in the header section;

searching for a sheet size corresponding to the image size based on the correspondence between the plurality of sheet sizes and the image size and the image size of the image data extracted from the attribute information;

selecting, when a sheet size corresponding to the image size is not found at the searching, a sheet size that can accommodate the image data when printed; and printing the image data on a print sheet corresponding to the sheet size selected at the selecting.

12. The image forming method according to claim 11, further comprising:

detecting whether the print sheet of the sheet size selected at the selecting is left in a paper feeding unit; and causing a displaying unit to display a message to notify that the print sheet of the sheet size selected at the selecting is not left in the paper feeding unit when the print sheet of the sheet size selected at the selecting in is not left in the paper feeding unit.

13. The image forming method according to claim 11, wherein, when a plurality of sheet sizes corresponding to the image size are found at the searching, the selecting includes selecting a sheet size that is smallest from among found sheet sizes.

14. The image forming method according to claim 13, wherein, when a sheet size corresponding to the image size is not found at the searching, the selecting include selecting a sheet size that is biggest from among the sheet sizes in the sheet-size decision table, and scaling down the image size so that the image size can fit in selected sheet size when printed.

15. The image forming method according to claim 11, further comprising searching a paper feeding unit that can feed a print sheet of the print size selected at the selecting, wherein when a paper feeding unit is not found in the searching, the selecting includes newly selecting a sheet size;

determining whether the image size can be accommodated in newly selected sheet size; and scaling down the image data so that image size of scaled-down image data is accommodated in the newly selected sheet size when printed upon determining that the image size cannot be accommodated in the newly selected sheet size.

* * * * *